US005815896A

United States Patent [19]

Dischler

[11] Patent Number: 5,815,896

[45] Date of Patent: Oct. 6, 1998

[54] METHOD AND APPARATUS TO PROVIDE IMPROVED AND MORE EFFICIENT NAPPING OF FABRICS MADE FROM SPUN YARNS

[75] Inventor: Louis Dischler, Spartanburg, S.C.

[73] Assignee: Milliken Research Corporation, Spartanburg, S.C.

[21] Appl. No.: 995,184

[22] Filed: Dec. 22, 1997

[51] Int. Cl.[6] ..... D06C 19/00

[52] U.S. Cl. ..... 26/28; 26/7; 26/17; 26/29 R

[58] Field of Search ..... 26/27, 28, 7, 17, 26/11, 18.6, 29 R, 32, 31, 37; 28/162, 163, 170; 451/49, 178, 188, 190, 207, 209, 210

[56] References Cited

U.S. PATENT DOCUMENTS

| | | | |
|---|---|---|---|
| 2,053,778 | 9/1936 | Platt | 26/28 |
| 2,253,559 | 8/1941 | Curtin | 26/28 |
| 3,499,195 | 3/1970 | Wethington | 451/190 |
| 3,534,188 | 10/1970 | Holm et al. | 26/17 |
| 3,553,801 | 1/1971 | Hadley | 26/28 |
| 3,683,559 | 8/1972 | Kalwaites | 26/28 |
| 3,872,557 | 3/1975 | Benzaquen | 26/28 |
| 4,918,795 | 4/1990 | Dischler | 26/1 |
| 4,947,528 | 8/1990 | Dischler | 26/2 R |
| 5,012,562 | 5/1991 | Catallo | 26/18.6 |
| 5,058,329 | 10/1991 | Love et al. | 51/323 |
| 5,109,630 | 5/1992 | Love et al. | 51/74 R |
| 5,205,140 | 4/1993 | Nielsen et al. | 66/147 |
| 5,218,747 | 6/1993 | Riedel | 26/28 |
| 5,531,630 | 7/1996 | Crosta | 26/17 |

FOREIGN PATENT DOCUMENTS

| | | | |
|---|---|---|---|
| 40787 | 6/1986 | Japan | 26/28 |

*Primary Examiner*—Amy B. Vanatta
*Attorney, Agent, or Firm*—Terry T. Moyer; William S. Parks

[57] ABSTRACT

A method and apparatus for loosening, cutting, and abrading a web of textile fabric having spun yarns containing wrapper fibers. The textile fabric web is directed under high tension around pairs of rotatable, small diameter tubes coated with abrasive particles. Abrasive particles are preferably rounded (nonfaceted) tungsten carbide particles. The tubes (rolls) are rotated at differing speeds in relation to the fabric web speed through the apparatus. Preferably, the first, regressive roll rotates at a speed slower than the web speed and the second, progressive roll rotates at a faster such speed. Such a process and apparatus provide improved conditioning and napping of a fabric web as well as a quicker, more efficient method of performing such fabric treatment.

20 Claims, 3 Drawing Sheets

FIG. –1–

METHOD AND APPARATUS TO PROVIDE IMPROVED AND MORE EFFICIENT NAPPING OF FABRICS MADE FROM SPUN YARNS

BACKGROUND OF THE INVENTION

There are several types of spun yarns commonly used in the construction of woven fabrics. Among the most common, and familiar to those versed in the art, are ring spun, open-end spun (OES), air-jet spun (AJS), and rollerjet spun (RJS) yarns. Ring spun yarns consist of generally helically wound fibers which, when woven into fabrics, exhibit excellent hand and strength characteristics. It is known that, as the twist level is increased for ring spun yarns, the fabric containing them becomes stiffer and harsher, as increased twist reduces fiber-to-fiber mobility. OE yarns, compared to ring spun yarns, are more disorganized and have a lower twist. The fiber bundle comprising the yarn is compacted by the presence of tightly wound wrapper fibers, which are nearly perpendicular to the axis of the yarn. As the yarn structure of OE yarns is less organized than that of ring spun yarns, the OE yarn exhibits a larger diameter than that of a ring spun of an equivalent denier. The larger size of the OE yarn, coupled with the lack of mobility of the fibers, because of the pressure imparted by the wrapper fibers, results in a stiffer fabric, in spite of the lower twist as compared to ring spun yarns. The tightly wound wrapper fibers also cause the surface of the fabric to be harsh and scratchy to the touch. The relative fiber immobility makes it difficult to enhance the fabric by needling with hydraulic jets, as these yarns cannot easily blossom when constricted by the wrapper fibers. In the same way, wrapper fibers reduce the effectiveness of pneumatic vibratory softening as disclosed in my U.S. Pat. No. 4,918,795. As the wrapper fibers are not aligned with the axis of the yarn, they do not contribute to fabric strength, and fabrics constructed of yarns containing wrapper fibers are generally not as strong as fabrics constructed of ring spun yarns.

AJS and RJS yarns are similar to OE yarns, but have core fibers with little or no twist, and the integrity of the yarn entirely depends upon the presence of the wrapper fibers. Without the fiber-to-fiber friction created by the pressure exerted by the wrapper fibers, the yarn would have no tenacity and could not be woven into fabrics. Once a fabric has been woven, yarn-to-yarn pressures are sufficient to create frictional forces between fibers, and the wrapper fibers are no longer necessary for strength. Loosening or cutting wrapper fibers, by various means such as by sanding or napping, so as to improve the hand and other properties, without substantial cutting of the load bearing fibers, can dramatically improve the hand and surface touch of the fabric, allow the fabric to blossom when hydraulically needled or to soften when pneumatically vibrated, as well as abrading the fabric to improve adhesion to coatings, without degrading fabric strength. Other methods of sanding and abrading textile fabrics are known, such as that disclosed in U.S. Pat. No. 5,058,329, to Love et al., however they are not effective in severing or sufficiently loosening the wrapper fibers within the fabric in order to create significant associated benefits resulting therefrom without also cutting load bearing fibers and substantially reducing the strength of the fabric.

The present invention solves these problems in a manner not disclosed in the known prior art while treating fabric webs to a level at least four times greater than the method disclosed in my U.S. application Ser. No. 08/738,787, noted above. This application discloses abrasive fabric treatments similar, in spirit, to the overall processes as now claimed. However, my previous application utilizes a noticeably dissimilar apparatus and a vastly different procedure than within this current invention.

SUMMARY OF THE INVENTION

A method and apparatus for providing improved and efficient napping and sanding of spun yarns through the loosening, cutting, and abrading a web of textile fabric is contemplated within this invention. The textile fabric web is directed under high tension around at least one pair, and preferably four pairs, of rotatable, small diameter tubes (rolls) (approximately from one to ten inches in diameter) coated with abrasive particles bonded directly to the roll face. These abrasive particles are preferably rounded (nonfaceted) tungsten carbide particles. The rolls are rotated at differing speeds relative to the speed of the fabric web but in the same direction as the web.

As noted above, the rolls are paired wherein one is a regressive roll and the other a progressive roll. By regressive it is meant that the rotational speed of such a tube is slower than the speed of the fabric. By progressive it is meant that the rotational speed of the roll is faster than that of the fabric (web). When more than one pair is utilized, the fabric web must make contact with each sequential pair of rolls one pair at a time. An equal angular wrap is thus made by the fabric with these pairs of rolls wherein any tension added to the fabric web by each regressive roll is thereafter removed upon conditioning by its complementary progressive roll. This combination of rolls allows omission of intermediate drives which in turn reduces the size and complexity of such a machine while, at the same time, providing more efficient conditioning and napping of the fabric web than with the known prior art devices.

The contact angle of the textile fabric web with each tube is between thirty (30) and one hundred and eighty (180) degrees, preferably less than one hundred and fifty (150) degrees, and most preferably from about sixty (60) to about one hundred and twenty (120) degrees. Also, the average pressure between the textile fabric web and the tube should exceed two (2) pounds per square inch (p.s.i.).

In one preferred embodiment, the absolute value difference between the web speed through the apparatus, where said web speed is taken to be 100%, and the rotational speed of the regressive rolls, measured as percentages of said web speed, are equal to the difference between the rotational speed of the progressive rolls, also measured as percentages of the web speed, less the web speed itself. As merely one example, the regressive rolls would rotate at a speed 20% of the speed of the web (100%) and the progressive rolls would rotate at a speed 180% of the speed of the web. The measured difference between web speed and regressive roll rotational speed, i.e., the relative rotational speed, is thus −80%, the absolute value of which (+80%) is equal to the relative rotational speed of the progressive rolls, which is 180% less 100%, or 80%. Through such an arrangement, the fabric receives a balanced, pile/counter-pile treatment which translates into the decreased need for further conditioning of the fabric in order to produce the same degree of napping as compared to, for example, the process and apparatus disclosed in my U.S. application Ser. No. 08/738,787, noted above. Furthermore, with such an arrangement of regressive and progressive rolls having equal absolute relative speeds, the treatment of the fabric is performed independently from the speed of the fabric itself through the machine. The actual speeds at which the rolls rotate is not important as long as the absolute relative speed parameters are met. Beneficially then, this specific grouping of rolls in pairs thus further allows for the start-up and the shut-down of the machine without creating fabric defects.

Another preferred embodiment is contemplated wherein the absolute value of the difference between the web speed and the relative rotational speed of the regressive rolls is less than the difference between the relative rotational speed of the progressive rolls and the web speed. As merely an example, the progressive rolls rotate at a speed 200% (+100%) of the fabric speed while the regressive rolls rotate at a speed 20% (−80%, absolute value of +80%) of the fabric speed. Although the balanced treatment of the fabric does not occur in this instance, a greater degree of conditioning (napping) of the fabric is obtained. It is believed this greater absolute treatment may be accomplished because the coefficient of dynamic friction of the web with the regressive and progressive rolls is relatively independent of roll to fabric surface speeds, at least for most fabrics.

Yet another preferred embodiment of this invention is wherein either the regressive rolls or the progressive rolls rotate at the same speed as the fabric web. In such a manner, those rolls would act as drive rolls for the fabric through the apparatus. Thus, the treatment of the fabric may be accomplished either by the progressive rolls, which would move faster than the fabric speed or by the regressive rolls, which would move slower than the fabric web. When the progressive rolls are acting as the drive rolls (and the regressive rolls treat the fabric), then the fabric may move through the apparatus at its fastest ultimate speed, since the progressive rolls are geared to turn faster than the regressive rolls. Such an arrangement is favorable where time is limited and a balanced treatment is not needed.

Still a further advantage and thus embodiment of this invention is the ability of the regressive roll or progressive roll or both types to freewheel when treatment of the fabric is not desired or the utilization of the apparatus is temporarily halted. Such an ability to become disengaged is facilitated through the use of a clutch mechanism to drive the treatment rolls. Actuation of the clutch disengages the drive motors from the treatment rolls. Tension variations upon the web are minimized through this disengagement of the rolls in pairs (one regressive roll and its paired progressive roll). This is particularly beneficial upon the detection of a seam since when the seam of the web nears a pair of rolls, the rolls are then disengaged until the seam passes that area. At that time, the rolls are reengaged and continue the conditioning procedure upon the fabric. This method permits minimal amounts of untreated fabric adjacent to the seam as opposed to systems which require shut down of treatment devices until the seam passes through the entire apparatus and is mechanically simpler than systems that employ an engagement roll to remove the fabric thread line from contact with the treatment devices.

These aforementioned embodiments are not meant to limit the scope of this invention. Other possible arrangements of rolls and speeds are contemplated and thus well within the teachings and disclosures of this invention.

OBJECTS OF THE INVENTION

The main object of this invention is to thereby provide improved napping and sanding of fabric webs comprising spun yarns through faster and more efficient means.

It is thus an additional advantage of this invention to provide greater adhesion between a textile fabric web and an applied chemical coating.

It is another advantage of this invention to be able to fully allow the individual yarns, having wrapper fibers, to blossom when subjected to hydro-enhancement treatment.

Another advantage of this invention is to reduce the compressive pressure exerted by the wrapper fibers to allow the fabric to be softened by pneumatic vibratory means.

Yet another advantage of this invention is to improve the hand of a textile fabric web.

Still another advantage of this invention is that it provides a very uniform treatment with good strength retention and minimal shade change for dyed fabric.

Another advantage of this invention is that the process is relatively insensitive to the speed of the textile fabric web.

These and other advantages will be in part apparent and in part pointed out below.

BRIEF DESCRIPTION OF THE DRAWINGS

The above as well as other objects of the invention will become more apparent from the following detailed description of the preferred embodiment of the invention, which when taken together with the accompanying drawings in which.

Corresponding reference characters indicate corresponding parts throughout the several views of the drawings.

DETAILED DESCRIPTION OF THE PREFERRED EMBODIMENTS

Figure 1:
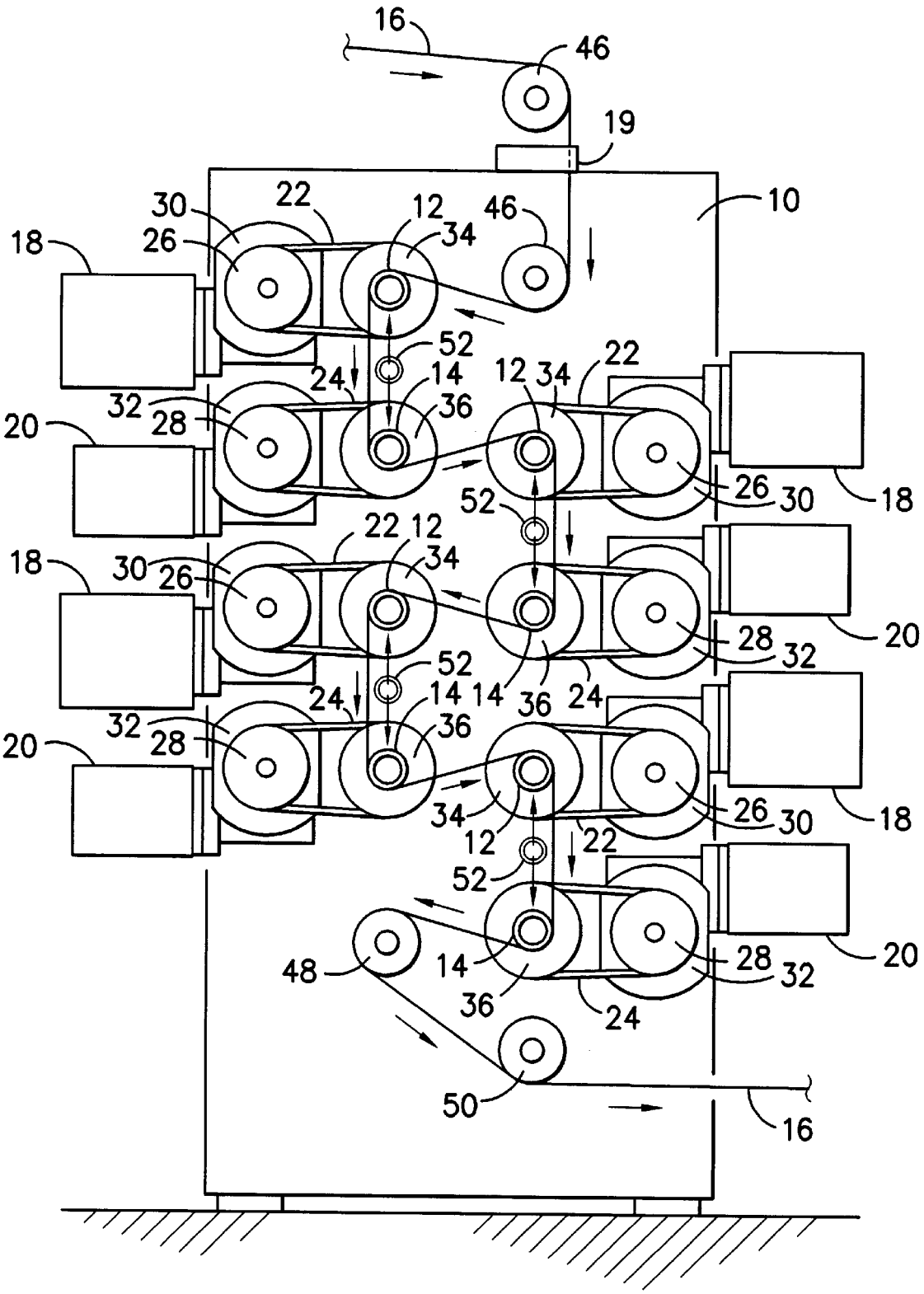
FIG. 1 is a cross-sectional view of the apparatus showing the thread line of the fabric as the web moves through the machine.
Figure 2:
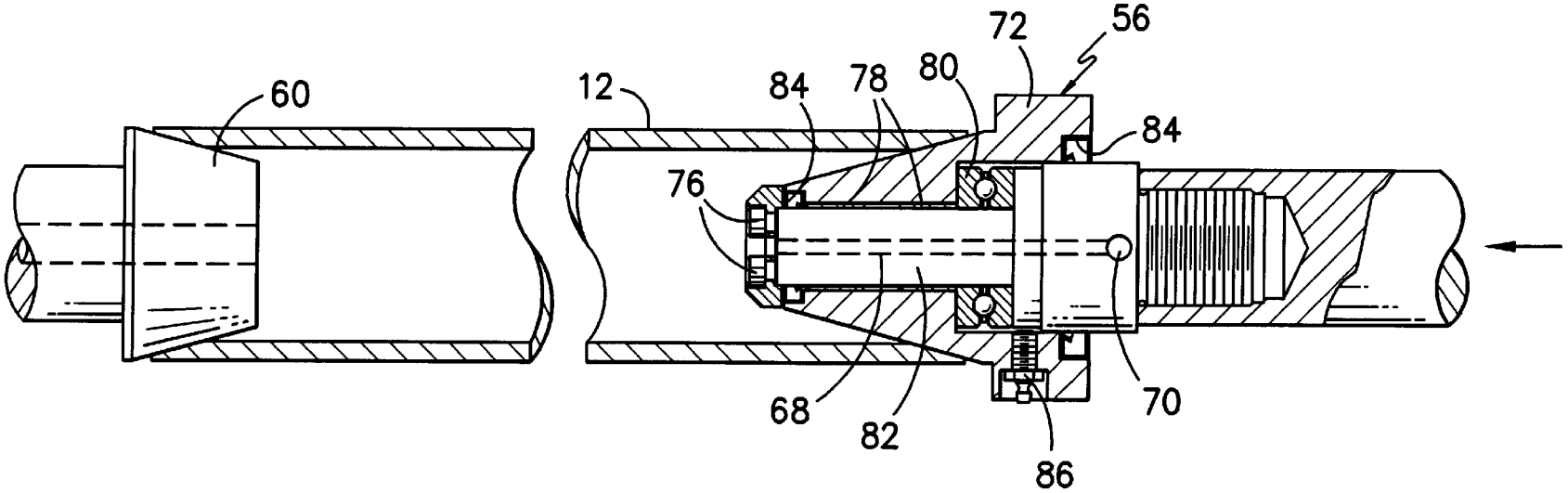
FIG. 2 is a cross-sectional view of the treatment roll conical clamp.
Figure 3:
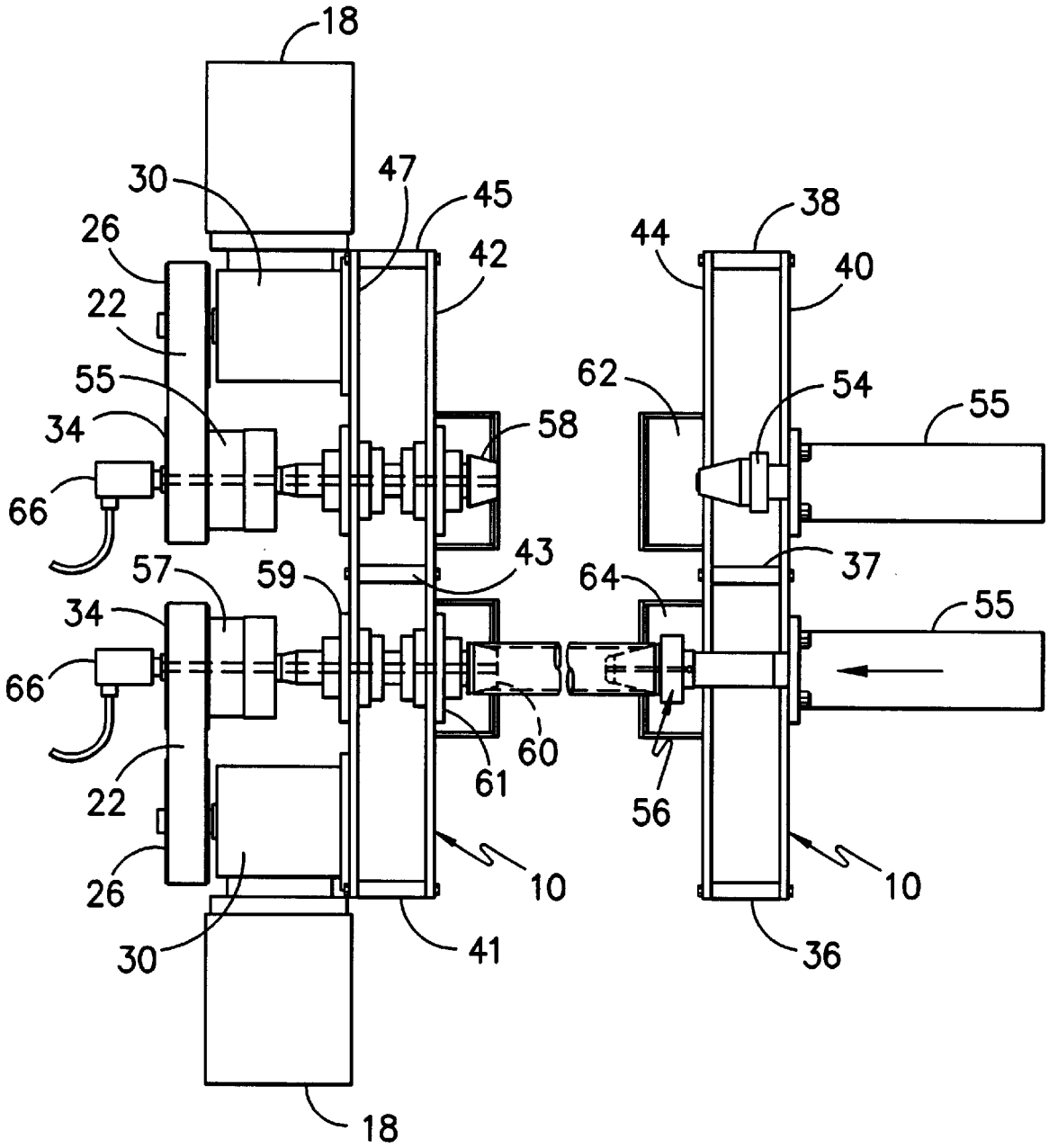
FIG. 3 is an aerial view of the fabric napping apparatus, showing the drives, rolls and clamping mechanism.

FIGS. 1, 2, and 3 all display an apparatus and components of an apparatus involving a potentially preferred practice of the present invention. As illustrated in FIG. 1 and part illustrated in FIG. 3, this apparatus comprises a frame 10 to which four pairs of treatment rolls 12, 14 are connected. The treatment rolls 12, 14 are preferably constructed from steel; however, any number of metals and alloys may be employed. Furthermore, the treatment rolls 12, 14 are preferably about 4 inches in diameter, but functional rolls may be employed with diameters as little as 1 inch or as great as 10 inches.

These pairs each comprise a regressive roll 12 and a progressive roll 14 which make contact with a textile fabric web 16 as it passes through the apparatus being driven by at least one drive roll (not illustrated) or by either the regressive rolls 12 or the progressive rolls 14. Each of the rolls 12, 14 is driven by drive motors 18, 20. Not shown are an entry drive roll prior to the apparatus and an exit drive roll subsequent to the apparatus. Tension is controlled by means of a load cell 19. The drive motor 18 for each of the regressive rolls 12 rotates these rolls 12 at a speed less than the speed at which the textile fabric web 16 is driven through the apparatus. Alternatively, the drive motor 18 for each for the regressive rolls 12 rotates at the same speed as the fabric web, thus permitting the regressive rolls 12 to act as the drive roll for the textile fabric web 16. This arrangement will only be utilized when the progressive rolls 14 remain rotating at a speed greater than that of the textile fabric web 16 as it is driven through the apparatus. The drive motors 18, 20 turn the rolls 12, 14 through the use of drive belts 22,24 which encircle drive sprockets 26, 28 within speed reducer assemblies 30, 32. The drive belts 22, 24 for each of the individual drive motors 18, 20 also encircle driven sprockets 34, 36 which are attached to drive cone assemblies 58, 60 by means of clutches 55, 57. Upon actuation of the driven clamp assemblies 54, 56, which are attached to the individual treatment rolls 12, 14, the treatment rolls 12, 14 then rotate. The drive motors 18, 20 are mounted to the speed reducer assemblies 30, 32, which in turn are mounted to the right side of the frame 10, comprising the bulkhead plates 40, 44, separated by bulkhead spacers 36, 37, 38. The retractable conical clamp assemblies 54, 56 are mounted to the pneumatically actuated clamp cylinders 55, which in turn are mounted to the left side of the frame 10, comprising the bulkhead plates 42, 43, separated by bulkhead spacers 36, 37, 38. The treatment rolls 12, 14 and fabric web 16 are located between the bulkhead plates 42, 44.

The textile fabric web 16 enters the apparatus, tension being controlled by means of a load cell 19 and is aligned for contact with the treatment rolls 12, 14 through the use of idler rolls 46. The web 16 contacts each roll at an angle of contact of about 105°, and passes through each pair of regressive rolls 12 and progressive rolls 14 sequentially from the top of the apparatus to the bottom. After the web 16 passes through the series of four pairs of rolls 12, 14 it then makes contact with a scroll roll 48, which insures any creases or folds in the web 16 are removed, and then another idler roll 50 before the web 16 exits the apparatus. As the web 16 passes through the apparatus and over the treatment rolls 12, 14, the abrasive particles (not illustrated) bonded to the rolls 12, 14 pull and abrade fibers, loosen wrapper fibers, and have a combined napping and sanding action on the textile surface. Blow-off tubes 52 aid in removing this yarn residue from the treatment rolls 12, 14.

As illustrated in FIG. 3, the treatment rolls 12, 14 have internally beveled ends which match the drive cone 58, 60 on one end and the clamp cones 54, 56 (FIG. 2, also) on the other end, and said treatment rolls 12, 14 are driven by means of frictional contact with said drive cones 58, 60. This frictional contact allows a torque to be developed between the treatment roll 12, 14 and drive cone 58, 60 without slippage, with the maximum torque available directly proportional to the axial clamping force developed by the retractable conical clamp assembly 54, 56 (FIG. 2, also). The drive cones 58, 60 pass through the bulkhead plates 42, 43 with the aid of bearings 59, 61 which support the drive cones 58, 60. The clamp assemblies 54, 56 can be moved between clamped 56 and retracted 54 positions for quick replacement of the treatment rolls through the use of clamp cylinders 55. Engagement and disengagement of the treatment rolls 12, 14 are accomplished by means of clutches 55, 57.

During processing, frictional heat generated by the treatment may be removed by introducing cooling water into the treatment rolls 12, 14 by means of a rotary unions 66, communicating passageways coaxial with the drive cone assemblies 58, 60 (FIG. 2, also), and communicating passageways within the conical clamp assemblies 54, 56 (FIG. 2, also). The water is then collected in catch basins 62, 64 and disposed of.

The conical clamp assembly 54 is illustrated in FIG. 2. As mentioned above, water is introduced within these assemblies 54 in order to cool the treatment rolls 12, 14 (FIGS. 1 and 3, also). This water is drained through both a communicating passageway 68, located within a stationary shaft 82, and a drain hole 70, all present within the conical clamp 54. The housing 72 of the clamp is molded into a conical shape matching the internal bevel of the treatment rolls treatment rolls 12, 14 (FIGS. 1 and 3, also). The housing 72 is kept in place through the use of a cap 74 as well as screws 76, both present at the apex of the conical housing 72. Separating the housing 72 from the shaft 82 are two radial bearings 78, a thrust bearing 80, and two rubber seals 84. Furthermore, a grease fitting 86 is supplied to facilitate introduction of a lubricant into the shaft 82 of the clamp assembly 54.

This textile treatment is especially effective when performed prior to a process that mechanically works the fabric since the cutting of the wrapper fibers of spun yarns accelerates the softening process. In the case of polyester spun fabric, this effect is maximized when there is a calendaring step either before or after this process when the fabric has not yet been heat-set. Calendaring technology is disclosed in U.S. Pat. No. 5,404,626, which is incorporated by reference as fully set forth herein.

The process of this invention can be further enhanced by treating the textile fabric web 16, under low tension, by low pressure, high velocity streams of gaseous fluid. This technology is, as merely one example, fully disclosed in my U.S. Pat. No. 4,918,795, and my U.S. Patent application Ser. No. 08/593,670 and my U.S. Provisional application Ser. No. 60/027,244, all of which are incorporated by reference as fully set forth herein.

It is not intended that the scope of the invention be limited to the specific embodiment illustrated and described, rather, it is intended that the scope of the invention be defined by the appended claims and their equivalents.

What is claimed is:

1. An apparatus for loosening and cutting wrapper fibers of spun yarns in a moving textile fabric web comprising:

(a) a frame:

(b) at least one pair of rolls comprising a first, regressive roll and a second, progressive roll, wherein each of said first and second rolls is rotatably mounted on said frame and is coated with abrasive particles;

(c) a mechanism for supplying said textile fabric web under tension to said rolls;

(d) a mechanism for rotating said at least one pair of rolls, wherein said first and second rolls in each pair rotate at differing speeds with said first, regressive roll rotating at a speed slower than the fabric web speed through the apparatus and said second, progressive roll rotating at a speed faster than the fabric web speed through the apparatus; and (e) a mechanism for removing said textile fabric web, after treatment, from said at least one pair of rolls.

2. The apparatus of claim 1 wherein the absolute value, measured in percentage points, of the difference between the web speed through the apparatus, which is 100%, and the rotational speed of the first, regressive roll, which is measured as a percentage of said web speed is equal to the difference between the rotational speed of the second, progressive roll, also measured as a percentage of said web speed, and said web speed.

3. The apparatus of claim 1 wherein the absolute value, measured in percentage points, of the difference between the web speed through the apparatus, which is 100%, and the rotational speed of the first, regressive roll, which is measured as a percentage of web speed, is less than the difference between the rotational speed of the second, progressive roll, also measured as a percentage of said web speed, and said web speed.

4. The apparatus of claim 1 wherein the textile fabric web makes an angle of contact with each of said regressive and progressive rolls, wherein said angel of contact is greater than 45° and less than 180°.

5. The apparatus of claim 1 wherein there are 4 pairs of rolls within the apparatus and the textile fabric web passes over said pairs of rolls one pair at a time.

6. The apparatus of claim 2 wherein there are 4 pairs of rolls within the apparatus and the textile fabric passes over said pairs of rolls one pair at a time.

7. The apparatus of claim 3 wherein there are 4 pairs of rolls within the apparatus and the textile fabric web passes over said pairs of rolls one pair at a time.

8. The apparatus of claim 4 wherein there are 4 pairs of rolls within the apparatus and the textile fabric web passes over said pairs one pair at a time.

9. The apparatus of claim 1 further comprising (f) means to detect a seam in the textile fabric web;

(g) means for disengaging said at least one pair of rolls upon detection of said seam at a location adjacent to and prior to contact with said pair of rolls; and (h) means for reengaging said at least one pair of rolls upon detection of said seam at a location adjacent to and after passage over or through said pair of rolls while said pair of rolls is disengaged.

10. The apparatus of claim 1 wherein the mechanism (d) further comprises means for permitting freewheeling of at most one of said first and second roll of at least one pair of rolls in order to allow for the utilization of either the first, regressive roll or the second, progressive roll as a drive roll for the textile fabric web.

11. The apparatus of claim 1 wherein said rolls are from 1 to 10 inches in diameter.

12. A process for loosening and cutting wrapper fibers of spun yarns in a moving textile fabric web comprising:

(a) supplying said textile fabric web under tension to an apparatus having at least one pair of rolls, comprising a first, regressive roll and a second, progressive roll, wherein each of said first and second rolls is coated with abrasive particles;

(b) rotating said at least one pair of rolls upon contact with said fabric web, wherein the individual rolls in each pair of rolls rotate at differing speeds, with said first, regressive roll rotating at a speed slower than the web speed through the apparatus and with said second, progressive roll rotating at a speed faster than the web speed through the apparatus; and (c) removing said textile fabric web after treatment.

13. The process of claim 12 wherein the absolute value, measured in percentage points, of the difference between the web speed through the apparatus, which is 100%, and the rotational speed of the first, regressive roll, which is measured as a percentage of said web speed, is equal to the difference between the rotational speed of the second, progressive roll, which is also measured as a percentage as said web speed, and said web speed.

14. The process of claim 12 wherein the absolute value, measured in percentage points, of the difference between the web speed through the apparatus, which is 100%, and the rotational speed of the first, regressive roll, which is measured as a percentage of said web speed, is less than the difference between the rotational speed of the second, progressive roll, which is also measured as a percentage of said web speed, and said web speed.

15. The process of claim 12 wherein the textile fabric web makes contact with said regressive roll at an angle of contact which is equal to the angle of contact of which the textile fabric web makes in contact with said regressive roll.

16. The process of claim 12 wherein there are 4 pairs of rolls within the apparatus and the textile fabric web passes over said pairs of rolls one pair at a time.

17. The process of claim 13 wherein there are 4 pairs of rolls within the apparatus and the textile fabric web passes over said pairs of rolls one pair a time.

18. The process of claim 14 wherein there are 4 pairs of rolls within the apparatus and the textile fabric web passes over said pairs of rolls one pair at a time.

19. The process of claim 15 wherein there are 4 pairs of rolls within the apparatus and the textile fabric web passes over said pairs of rolls one pair at a time.

20. A fabric surface treated in accordance with the process of claim 12.

* * * * *